US009630244B2

(12) United States Patent
Jarry et al.

(10) Patent No.: US 9,630,244 B2
(45) Date of Patent: Apr. 25, 2017

(54) DOUBLE-JET COOLING DEVICE FOR SEMICONTINUOUS VERTICAL CASTING MOULD

(71) Applicant: CONSTELLIUM FRANCE, Paris (FR)

(72) Inventors: Philipe Jarry, Grenoble (FR); Olivier Ribaud, Renage (FR); Pierre-Yves Menet, Saint Jean de Moirans (FR); Laurent Jouet Pastre, Mulhouse (FR); Emmanuel Waz, Chambery (FR); Aurele Mariaux, Grenoble (FR)

(73) Assignee: CONSTELLIUM ISSOIRE, Issoire (FR)

( * ) Notice: Subject to any disclaimer, the term of this patent is extended or adjusted under 35 U.S.C. 154(b) by 0 days.

(21) Appl. No.: 14/370,845

(22) PCT Filed: Jan. 8, 2013

(86) PCT No.: PCT/FR2013/000008
§ 371 (c)(1),
(2) Date: Jul. 7, 2014

(87) PCT Pub. No.: WO2013/104846
PCT Pub. Date: Jul. 18, 2013

(65) Prior Publication Data

US 2014/0374052 A1 Dec. 25, 2014

(30) Foreign Application Priority Data

Jan. 10, 2012 (FR) ..... 12 00072

(51) Int. Cl.
*B22D 11/124* (2006.01)
*B22D 11/049* (2006.01)
(Continued)

(52) U.S. Cl.
CPC ..... *B22D 11/124* (2013.01); *B22D 11/049* (2013.01); *B22D 11/20* (2013.01); *B22D 30/00* (2013.01); *B22D 11/14* (2013.01)

(58) Field of Classification Search
CPC ..... B22D 11/049; B22D 11/20; B22D 11/14; B22D 11/124; B22D 30/00
See application file for complete search history.

(56) References Cited

U.S. PATENT DOCUMENTS 5,518,063 A 5/1996 Wagstaff et al.
5,582,230 A 12/1996 Wagstaff et al.
(Continued)

FOREIGN PATENT DOCUMENTS

FR 1138627 12/1955
WO 9920418 A1 4/1999
(Continued)

OTHER PUBLICATIONS

International Search Report received in PCT/FR2013/000008, mailed Jun. 12, 2013.

*Primary Examiner* — Keith Walker
*Assistant Examiner* — Steven Ha
(74) *Attorney, Agent, or Firm* — McBee Moore Woodward Vanik IP LLC

(57) ABSTRACT

The subject matter of the invention is a device for the direct cooling of a mould for the vertical semicontinuous casting of rolling ingots or extrusion billets (3) with gradual quenching by double jet (4 and 5), the first at substantially 32° and second at substantially 22°, simultaneously and delivering substantially the same flow rates and speeds from a single liquid chamber (2).
Another subject of the invention is a method using said device, with or without graphite insert (1) on the working faces and in association with various bottom block configurations.

12 Claims, 6 Drawing Sheets

(51) Int. Cl.

| | |
|---|---|
| ***B22D 11/20*** | (2006.01) |
| ***B22D 30/00*** | (2006.01) |
| *B22D 11/14* | (2006.01) |

(56) References Cited

U.S. PATENT DOCUMENTS

| | | | | |
|---|---|---|---|---|
| 5,685,359 | A | 11/1997 | Wagstaff et al. | |
| 7,007,739 | B2 | 3/2006 | Shaber | |
| 7,011,140 | B1 | 3/2006 | Yu et al. | |
| 2002/0174971 | A1* | 11/2002 | Langlais | B22D 11/049 164/487 |
| 2009/0050290 | A1* | 2/2009 | Anderson et al. | 164/483 |
| 2012/0241118 | A1* | 9/2012 | Wagstaff et al. | 164/128 |

FOREIGN PATENT DOCUMENTS

| | | | |
|---|---|---|---|
| WO | 0240199 | A2 | 5/2002 |
| WO | 2005092540 | A1 | 10/2005 |

* cited by examiner

DOUBLE-JET COOLING DEVICE FOR SEMICONTINUOUS VERTICAL CASTING MOULD

CROSS REFERENCE TO RELATED APPLICATIONS

This application is a §371 National Stage Application of PCT/FR2013/000008, filed Jan. 8, 2013, which claims priority to FR 1200072, filed Jan. 10, 2012.

BACKGROUND

Field of the Invention

The invention concerns the field of the manufacture of semifinished products such as rolling ingots and extrusion billets made from aluminium alloys by vertical semicontinuous casting.

More precisely, the invention concerns a direct-cooling device and method, with a double row of jets, providing gradual and continuous quenching of the product during solidification, and in particular during the phase where the casting starts, so as to control and minimise the phenomenon of butt curling, and allowing subsequent hot rolling, or extrusion, without prior sawing of the ingot foot, and this without tearing or cracking.

The ingot mould may or may not comprise, on the working surface thereof, a graphite insert in order to improve the surface finish in permanent regime.

The products may be intended for the manufacture of any application in the form of rolled sheets, strips, profiles or forged parts obtained by extrusion.

Description of Related Art

Rolling ingots and extrusion billets are typically manufactured by casting in a vertical mould, or ingot mould, positioned on a casting table above a casting pit.

The mould has a rectangular cross section in the case of ingots or circular in the case of billets, with open ends, with the exception of the bottom block at the start of casting positioned so that it allows initial filling of the mould before being moved down by an elevator system, while the mould continues to be fed by the top end. The mould and false bottom define the cavity in which the metal is cast.

At the start of the casting process, the bottom block is situated in its highest position in the mould. As soon as the metal is poured and cooled, typically by means of water, the bottom block is lowered down at a predetermined speed. The solidified metal is then extracted through the bottom part of the mould and the ingot or billet is thus formed.

This type of casting, in which the metal extracted from the mould is cooled directly by the impact of a cooling liquid, is known by the term semicontinuous casting, typically vertical, with direct cooling, or VDCC for vertical direct chill casting.

In semicontinuous casting, the difficulty lies in the success of the change from zero speed at the start of formation of the product to the permanent-regime or steady state speed. This change results in a deformation of the ingot base, known to persons skilled in the art by the term butt curling. If it is too pronounced, which occurs when the base is cooled too violently, the butt curl may cause what persons skilled in the art call "bleed-out", which may sometimes degenerate into "hang-up", that is to say a jamming of the ingot in its mould. The butt curl associated with an unsuitable cooling regime may, less catastrophically, result in the breaking of the base or to cracks in the base. These breakages or cracks are entirely detrimental since they may propagate in permanent regime leading thereby to the scrapping of the product, or otherwise, and at the very least, they prevent the hot rolling of the ingot without sawing of the base in order to restore the integrity of the product. Finally, a butt curl that does not cause any scrapping of the casting does however result in variations in cross section of the product, which may prevent the rolling of the products without sawing of the ingot foot.

In order to limit butt curl, it is known to persons skilled in the art that it is necessary to extract less heat from the product during the start-up phase of the casting than in steady state. For this various technologies have been developed (pulsation, injection of $CO_2$ into the start-up water, use of V-shaped ingot moulds and curved bottom blocks). The most efficient techniques consist of sufficiently reducing the cooling flow rate during start-up in order to obtain a stable film boiling regime, which extracts much less heat than the nucleated boiling regime or the streaming regime. Moreover, it is known that the rate of butt curling is an increasing function of the start-up speed, which leads to starting the casting at a speed that is generally lower than the steady state casting speed. It is therefore known to persons skilled in the art that the most important parameters are the filling speed and the casting temperature, a small extraction of heat at the beginning of the start-up phase using a sufficiently small quantity of water of suitable thermal efficiency in relation to its quality, the appropriate choice of the start-up speed with regard to the initial flow rate of water, and finally the choice, at the end of the start-up phase, of the ramping up of the casting speed and of the cooling water flow rate, which make it possible to achieve speed and cooling parameters suited to the steady state regime while guaranteeing a good soundness of the ingot foot and minimisation of curling thereof.

This can be obtained with ingot moulds known by the term "waterholes", the interior architecture and hole diameters of which make it possible to achieve very low flow rates while guaranteeing very good uniformity of flow along the mould.

These moulds comprise either a horizontal row of holes, or two rows placed one above the other.

The application WO 2005/092540 A1 and the patents U.S. Pat. Nos. 7,007,739 B2, 5,518,063; 5,582,230 and 5,685,359 of Wagstaff Inc. disclose a sequential spray system, first of all with a first row of holes at a 22° angle of incidence, which provides the film boiling regime during start-up, and then adding above it a second row of jets issuing from holes at 45°, which end film boiling and provide sufficient cooling in permanent regime. The high differentiation between the regime with a row of jets at a low angle of incidence and the regime with spraying by the two jets, one of which has a high angle of incidence, is explicitly claimed by Wagstaff Inc.

Each of these two systems (with one or two rows as above) has drawbacks:

Moulds of the "waterhole" type with one row of holes effectively make it possible to obtain a film boiling regime with a low flow rate per unit length of mould, but they are very sensitive to the quality of the water. This is because firstly the minimum flow rate per unit length accessible with a single row of holes is not as low as when only half of the holes spray the product, as in the Wagstaff Inc. moulds sold under the names "Epsilon™" OR "LHC™" (the latter with graphite insert on the working faces). Consequently the operating point of these moulds with one row of holes is, by construction, closer to the transition to nucleate boiling, i.e. the so-called Leidenfrost point on the Nukiyama curve known to persons skilled in the art, that is to say a small variation in flow rate along the mould, or in water temperature or in water quality may easily tip the film boiling operating point towards nucleate boiling. This is why these moulds cannot be used correctly when the water is too cold, or when it is subject to seasonal variations in quality.

Sequential-cooling moulds ("Epsilon™" and "LHC™" from Wagstaff Inc.) are for their part much less sensitive to water quality since their operating point is much further from the Leidenfrost point because of the very low start-up water flow rate when only half the holes spray the product, moreover at a low angle of incidence. However, this technology has several drawbacks:

The first drawback of this technology, which explicitly claims the differentiation between the first and second spraying regimes, is the double curling phenomenon. This is because a first curling occurs at start-up with a first row of jets at an angle of incidence of 22°. Then, a second curling occurs when the jets are activated at 45°. It is necessary to know that the mechanical phenomenon of butt curling does not stop abruptly but continues to have its effects felt until late during the casting, that is to say at 1 m of cast length and more. This sequential-spraying system helps to significantly extend this transient mechanical curling regime. During the subsequent hot rolling of the ingot, this results in a risk of cracking between the first and second bowing and to the rolling rejects that result therefrom. Thus the moulds of the prior art have been optimised on the sole criterion of casting recovery and not on the behaviour under rolling of the ingot bases thus formed.

The second drawback relates to so-called but swell, prolonged because of the very low spraying rate during the first casting start-up phase.

The third drawback is the incompatibility of this technology with the casting of so-called hard alloys. This is because these are often characterised by high sensitivity to hot cracking on the one hand and by the fact that very high stresses appear therein quickly during cooling. It is essential to limit all local temperature gradients that may result in locally very high internal stresses. However, firstly the spraying phase at very low rate is propitious to hot cracking, for two reasons: the excessive time spent by the surface metal in the dangerous solidified fraction zone (the presence of a weakening residual liquid fraction) before the impact, situated very low, of the 22° jets, and the excessive spacing between the 22° jets that creates local thermal gradients propitious to the initiation of cracks, and secondly by the abrupt application of a second spraying at a high angle of incidence after the low angle of incidence regime creates precisely the conditions for appearance of a very high local thermal gradient and stresses that accompany it.

The Stated Problem

The present invention proposes to afford a solution to the problem of double curling of the ingot foot and ingot base quality, without the drawbacks that have been noted for the existing solutions, among other things and in particular for hard alloys.

It aims to optimise the start-up of the casting not only on a criterion of recovery during start-up but also on a criterion of suitability for subsequent conversion by hot rolling.

It also aims to broaden the field of applicability of all types of aluminium alloys.

It should be noted in this regard that all the aluminium alloys dealt with hereinafter are designated, unless mentioned to the contrary, in accordance with the designations defined by the Aluminum Association in the Registration Record Series that it publishes regularly.

SUMMARY

The subject matter of the invention is a device for cooling a vertical semicontinuous casting mould with direct cooling of rolling ingots or extrusion billets (3), consisting of two rows of holes, disposed over the whole of the internal perimeter of the mould cavity, in its lower part where the ingot or billet (3) exits, each of the rows of holes being situated close to a plane perpendicular to the vertical axis of said mould, characterised in that:

a) the two rows of holes are connected to a single cooling-liquid chamber (2) provided in the body of said mould, b) the first row of said holes, that is to say the highest in the vertical mould, or the furthest upstream with regard to the dispensing of the liquid onto the ingot surface, is connected to said chamber (2) by means of channels for dispensing jets of (4) said cooling liquid onto said ingot or billet (3) with an angle of incidence of 32±5 degrees with respect to the vertical axis of the mould, c) the second row of said holes, that is to say the lowest in the vertical mould, or the furthest downstream with regard to the dispensing of the liquid, is connected to said chamber (2) by means of channels for dispensing jets of (5) said cooling liquid over said ingot or billet (3) with an angle of incidence of 22±5 degrees with respect to the vertical axis of the mould, d) the holes in the second row, the lowest or furthest downstream with regard to the dispensing of the liquid, are disposed substantially on the bisection of the gap between two holes in the first row, that is to say the highest or the furthest upstream, relative to the vertical axis of the mould.

DETAILED DESCRIPTION OF A PREFERRED EMBODIMENT

Figure 1:
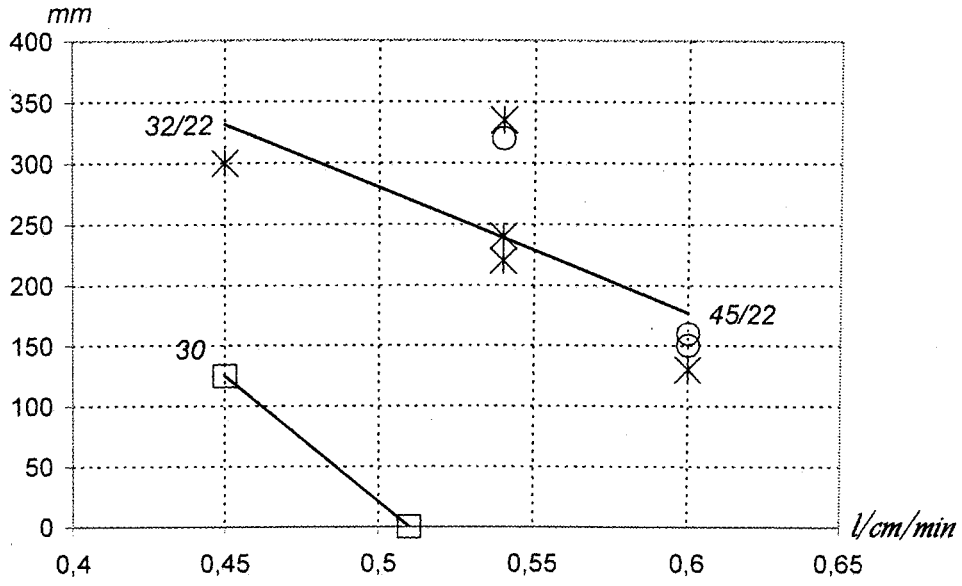
FIGS. 1-11 depict embodiments as described herein.

According to a preferred embodiment, the two rows of holes and said channels are organised with respect to the cooling-liquid chamber (2), and in particular the diameters of the holes are substantially equal, on the same row and between two rows, in order to be able to dispense said liquid simultaneously with flow rates and speeds that are substantially equal over the two rows of holes, both during the start-up phase and during the permanent casting regime. This is obtained using holes with substantially equal diameters on the same row and between the two rows.

Preferably, the two rows of holes of said cooling device are disposed with respect to each other so as to produce jets (4 and 5) which, if they are straight, form, at any moment in the casting, both during start-up and during permanent regime, impacts on the substantially vertical surface containing the working face of the mould, spaced apart from one another by a distance of between 10 and 40 mm in the vertical direction.

Also preferentially, the diameter of each of said holes in each row is 3±1 mm.

Advantageously, the spacing between two adjacent holes on the same row is between 10 and 30 mm.

Another subject matter of the invention is a method for using said cooling device as described previously for the vertical semicontinuous casting with direct cooling of rolling ingots or extrusion billets (3), and such that the total flow rate of cooling water for all the holes in the two rows, that is to say the flow leaving the cooling-liquid chamber (2), is between 0.3 and 0.8 liters/min per linear cm of mould perimeter, at the start of the transient phase of start-up of the casting, the phase during which the flow rate of cooling liquid and the casting speed have not reached their steady state value as described in the section "Prior art", and is then raised to the required flow rate for the permanent casting regime, typically 1 liter/cm/min or more.

More preferentially, said flow rate of water at the beginning of the transient start-up phase of the casting is between 0.4 and 0.6 liters/cm/min.

Advantageously, the cooling liquid is simultaneously brought to all the holes in the two rows during the casting start-up phase, so that the phenomenon of butt curling occurs gradually, in a distributed and continuous manner, while being minimised because of the flow of said liquid.

According to a particular embodiment, the method for using said cooling device for the vertical semicontinuous casting of rolling ingots (3) uses a slab casting mould provided with a flat bottom block the edges of which lie in a substantially horizontal plane.

According to an even more advantageous embodiment, it uses a slab casting mould provided with a curved bottom block, or a casting mould provided with a flat bottom block with a curved edge so that, in both cases, the middle of the rolling faces of the product are, during the casting start-up phase, subjected to the direct cooling by the cooling liquid while the regions of the rolling face furthest away from the face middle have not yet left the mould.

Finally, said method for using said cooling device for the vertical semicontinuous casting with direct cooling of rolling ingots or extrusion billets (3) can use a casting mould provided, on the working face thereof, with a graphite insert (1).

FIG. 1 shows the film boiling length in millimeters, obtained in the case of example 1, according to the initial flow rate per unit length at the start-up of the casting, in liters/cm of mould perimeter per minute, for three types of mould with the same format 2600×350 mm:

a mould with a single row of holes with a jet angle of incidence of 30° (marked 30, square symbols), a mould with two rows of holes with angles of incidence of respectively 45° and 22° activated simultaneously (marked 45/22, circular symbols), a mould with two rows of holes with angles of incidence of respectively 32° and 22°, according to the invention (marked 32-22, asterisks).

Figure 2:
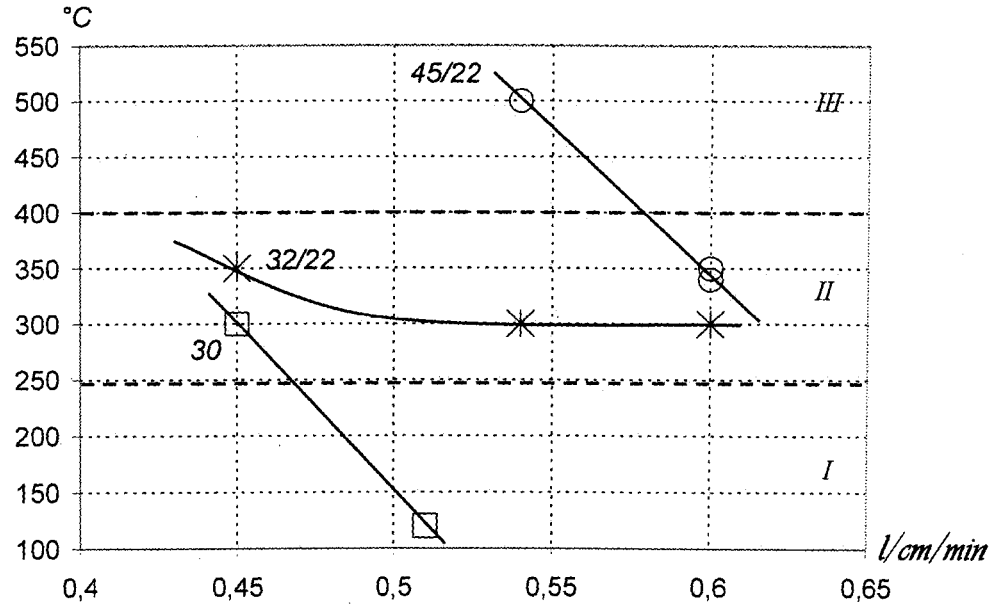

FIG. 2 shows the variation in surface temperature of the ingots of example 1, measured substantially at mid width at the mould exit, in ° C., as a function of the same flow rate and for the same moulds referenced in the same way as previously.

Three zones can be seen thereon: zone I without film boiling, zone II with stable film boiling and good soundness of the ingot foot, zone III with film boiling but hot cracking of the ingot foot.

Figure 3:
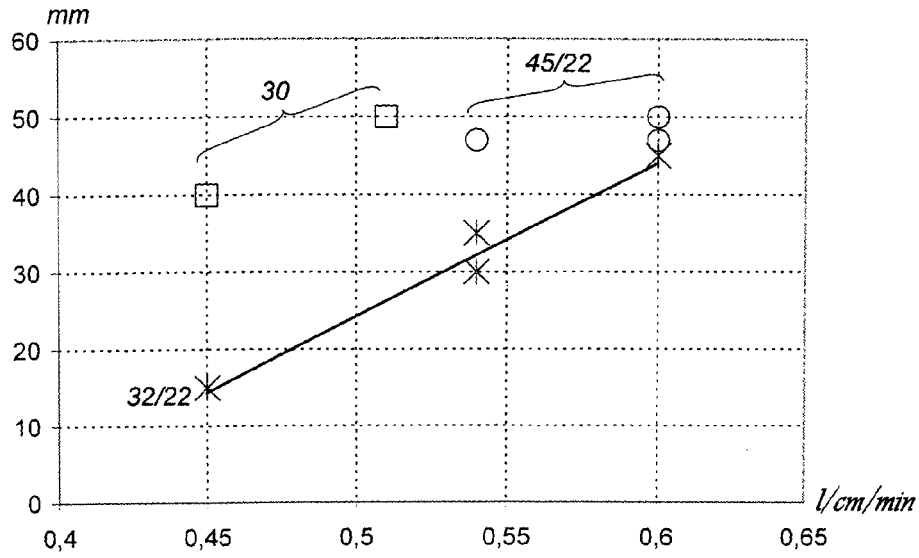

FIG. 3 shows the change in the butt curl, obtained in the case of example 1, in millimeters, according to the initial flow rate per unit length at the start-up of casting, in liters/linear cm of mould perimeter and per minute, for three types of mould identical to the previous ones and marked in the same way.

Figure 4:
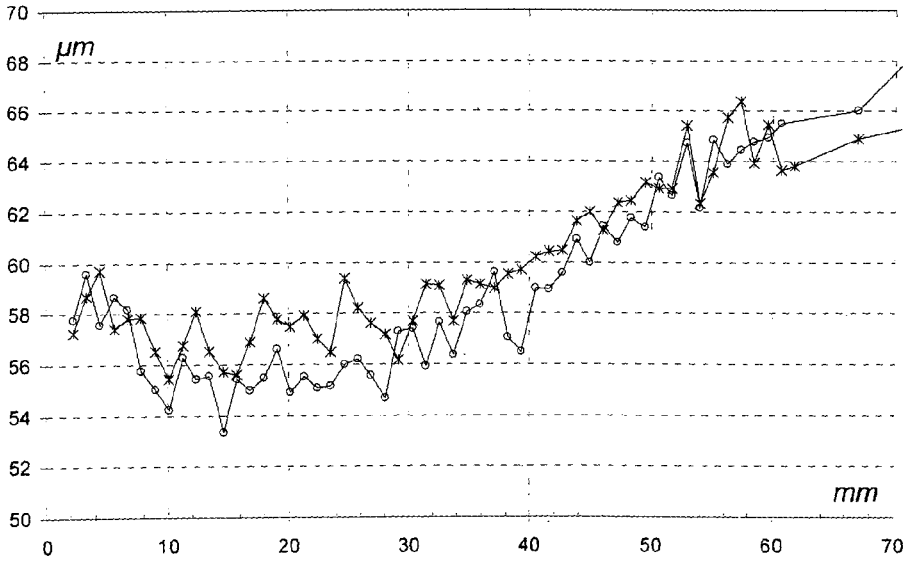

FIG. 4 shows the size of the solidification cells, in μm, as a function of the distance to the casting skin, in mm, obtained in steady state on an ingot of example 2. The symbols in asterisks relate to the mould with two rows of holes with angles of incidence of 32° and 22° and with a graphite insert, according to the invention, the symbols in a circle to a Wagstaff LHC™ mould with rows of holes with angles of incidence of 45° and 22°.

Figure 5:
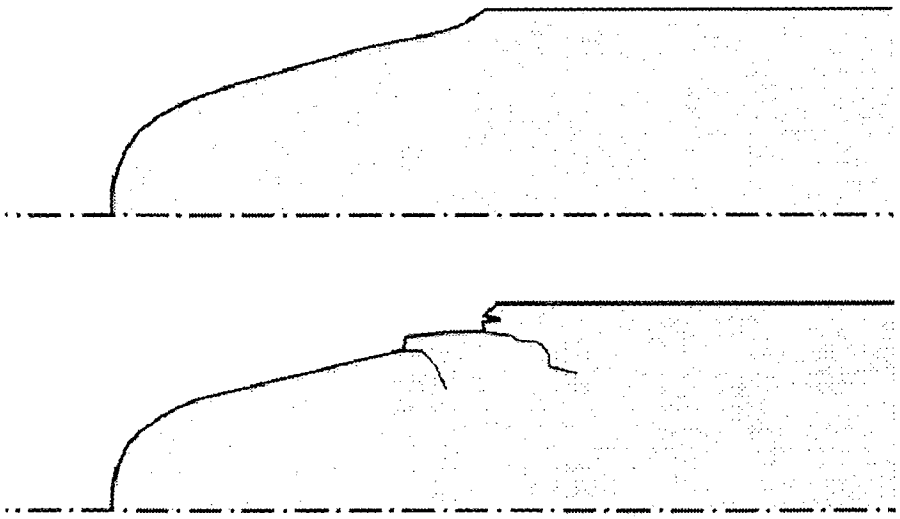

FIG. 5 shows the typical forms of strips obtained by hot rolling of an ingot base (only a half-width is drawn), on the left from an ingot cast with a mould according to the invention, on the right with a Wagstaff 45/22 LHC™ mould with sequential cooling during the phase of starting of formation of the ingot foot.

Figure 6:
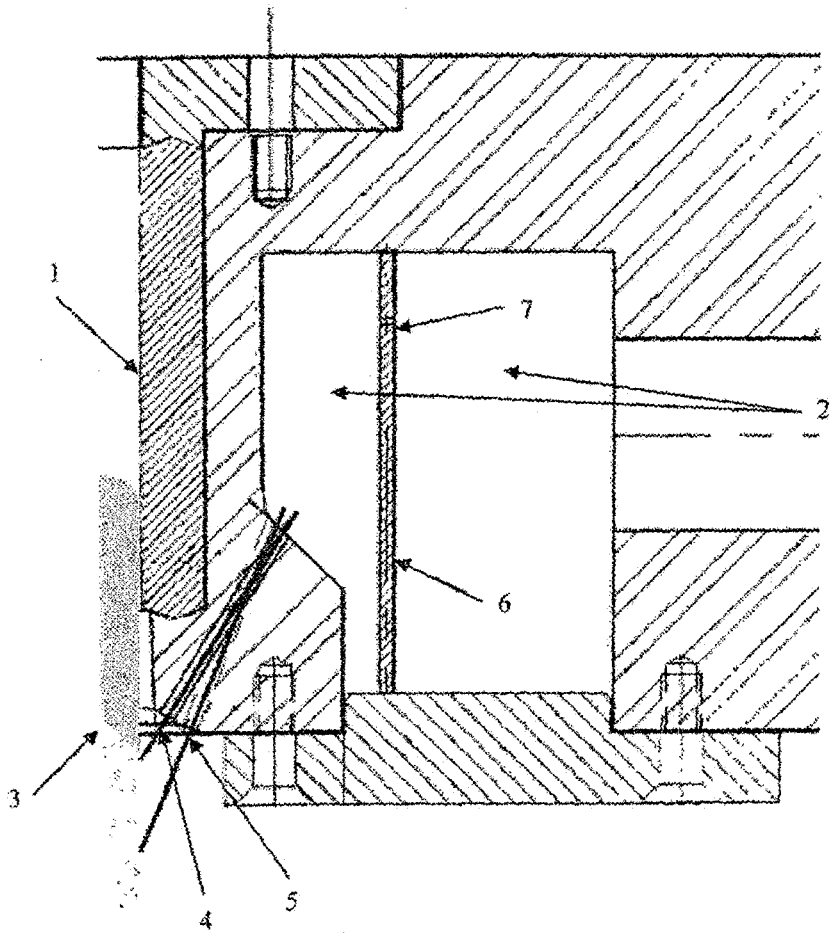

FIG. 6 shows a view in section of a mould according to the invention, provided with a graphite insert 1 on the working face, its single water chamber at 2, the cast ingot 3 being shown at the bottom left-hand end of the cross section, in uniform grey tint, with the two incident streams at 32° and 22° of cooling liquid, respectively 4 and 5.

In this embodiment, the chamber comprises a partition or diaphragm 6, provided with at least one orifice 7 so as to even out the flow of liquid delivered.

Figure 7:
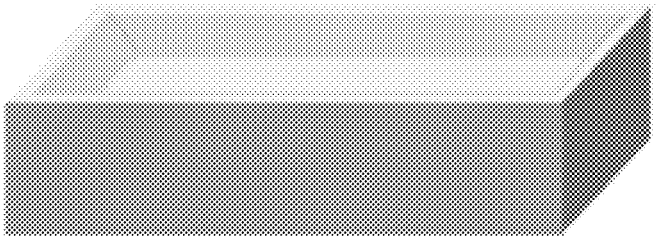

FIG. 7 shows a 3D view of a flat bottom block.

Figure 8:
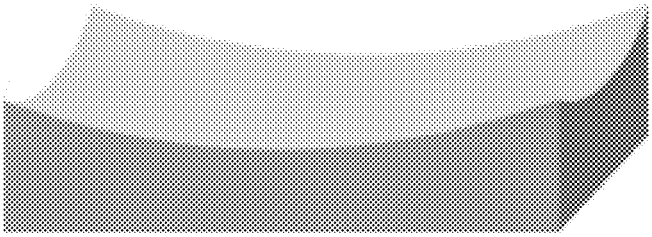

FIG. 8 shows a 3D view of a curved bottom block.

Figure 9:
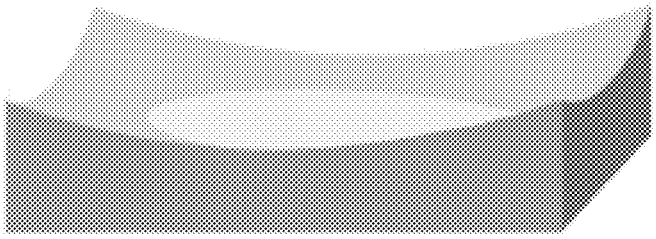
Figure 10:
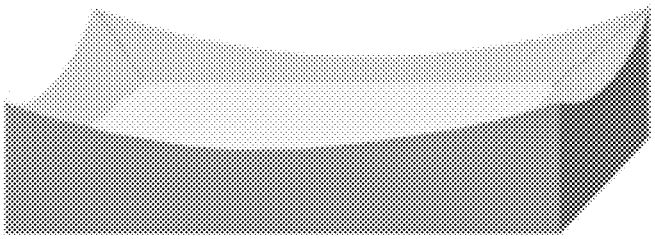
Figure 11A:
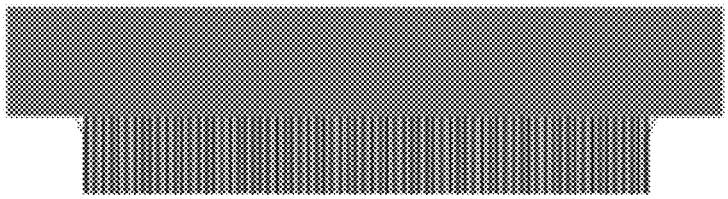
Figure 11B:
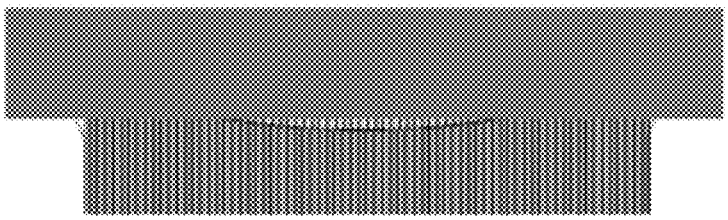
Figure 11C:
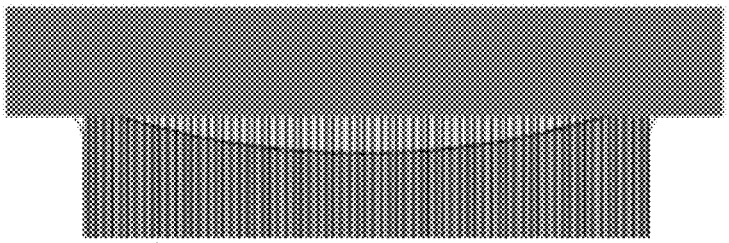
Figure 11D:
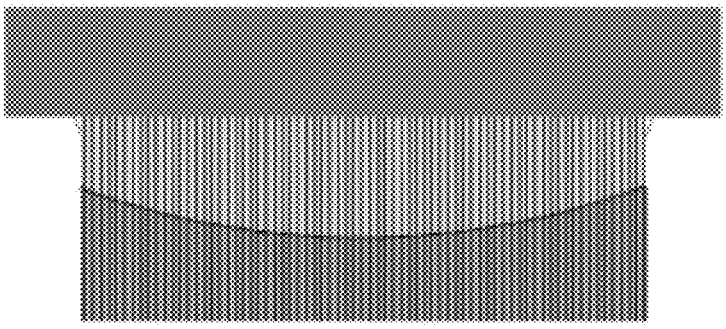

FIGS. 9 and 10 show two variants of a flat bottom block with curved edges.

FIGS. 11A-D show a view of a slab casting mould at different times of the casting start-up phase, in the case of a curved bottom block or a flat bottom block with curved edges:

11A: Before moving down the bottom block, it is in the highest position in the casting mould, and the cooling is already working.

11B: As starting moving down, the first part of the ingot base to be sprayed by the cooling liquid is the center of the slab, whereas the regions of the rolling face farthest from the middle portion have not yet left the mould.

11C: Progressively with increasing moving down the casting block, the cooled part of the ingot base increases, but the regions of the rolling face farthest from the middle portion have not yet fully left the mould.

11D: Once the bottom block has fully left the mould, the whole width of the ingot base is cooled.

So that the product is first of all sprayed at a very low rate, the system with two rows of jets is used.

However, the applicant has found that it suffices to divide the flow between two rows of jets activated simultaneously in order to obtain the required film boiling effect. There is no need for a sequential activation of the two rows of jets (4 and 5). They are therefore activated simultaneously in order to avoid the drawback noted for sequential spraying, namely an excessively strong phenomenon of double butt curling and exaggerated prolonging of the transient mechanical start-up regime that causes a prolonged so-called butt swell.

The angle of incidence of the jets is an essential parameter of the invention.

The angle of incidence of the first row of jets that sprays the product is the most direct. However, the applicant has found that, the more direct this angle of incidence, the less extensive is the range of flow rate in which the film boiling regime is stable. The first row of jets (4) that sprays the product must therefore have an angle of incidence of around 32°±5°, to enable a stable film boiling regime to be established.

The second row of jets (5) must therefore have an even smaller angle of incidence such that the impact distance between the two rows of jets is sufficient for the film boiling regime to have the time to establish. Two rows of jets that are too close together are in fact equivalent to a single row of jets. Typically the second row of jets (5) has an angle of incidence of around 22°±5° so that the vertical distance between impacts of the jets issuing from each of the two rows is between 10 and 40 mm.

Thus a quenching effect that is spatially gradual is obtained with moderate cooling, obtained by a first row, and then by a second row of jets around 20 millimeters lower. The spatial gradualness of the quenching can be improved in the lateral direction by the use of curved bottoms blocks or curved edges.

However, the invention also consists of obtaining a quenching effect that is gradual in time, by means of a gradual and simultaneous increase in the water flow on the two rows of jets, which avoids the particularly marked phenomenon of double butt curling inherent in the sequential jet technology.

This also makes it possible to cure the weak points vis-à-vis hot cracking that is situated between jets in the first row because of their spacing. These hot points are quickly cooled by the second series of jets with a low angle of incidence, disposed substantially on the bisection of the gap between the jets in the first row, which affords a gradual quenching of the surface of the metal.

The applicant found that the use of rows of jets with an angle of incidence of 32° and 22° made it possible to obtain a stable film boiling regime for cold water (down to 10° C.) and for flow rates per unit length that are significantly higher (up to 0.6 liters/cm/min) than for existing technologies. The start-up regime obtained is thus extremely robust, guaranteeing a degree of recovery close to 100% on casting. In addition, during the hot rolling of non-sawn ingots, the complete absence of cracks at the end and on edges has been shown, by virtue of the integrity of the ingot foot and the absence of disturbance of the cross section related to an exaggerated phenomenon of double butt curling. The applicant has also found that, in the casting of hard alloys, the surface slits occurring in steady state, observed in the case of a mould with a single row of jets, are eliminated with a mould with two rows of jets with an angle of incidence of 32° and 22°.

In its details, the invention will be better understood with the help of the following examples, which however have no limitative character.

EXAMPLES

Example 1

Rolling ingots to the 2600 mm×350 mm format made from an alloy of the AA7449 type were cast with moulds with holes for water cooling ("waterhole") of various types:

A mould with a single horizontal row of holes with a diameter of 3.2 mm spaced apart by 6 mm, with a cooling water jet angle of incidence on the ingot at the mould exit of 30° with respect to the vertical axis. Cooling water flow rates per unit length, at the start of casting, of 0.45 to 0.51 liters per linear cm of mould perimeter/min were tested. The flow rate was then increased to 1 liter/cm/min in steady state.

A mould with two rows of horizontal holes placed one above the other, activated simultaneously, all the holes having a diameter of 3.2 mm and being spaced apart from each other on each row by 12 mm, and such that the impacts of the jets issuing from these two rows are distant from one another along the vertical axis by 18 mm, each of the holes in the lower row being disposed substantially on the bisection to the gap between two holes in the upper row.

The angle of incidence, here simultaneous, of the cooling water jets on the ingot emerging from the mould was 45° and 22° with respect to the vertical axis.

Total flow rates per unit length (that is to say for all the holes in the two rows) of cooling water, at the start of casting, of 0.55 to 0.60 liters per linear cm of mould perimeter/min were tested. The flow rate was then increased to 1 liter/cm/min in steady state.

A mould according to the invention, with two horizontal rows of holes placed one above the other, all the holes having a diameter of 3.2 mm and being spaced apart on each row by 12 mm, each of the holes in the lower row being disposed substantially on the bisection to the gap between two holes in the upper row.

The angles of incidence of the cooling water jets, activated simultaneously, on the ingot at the mould exit were 32° and 22° with respect to the vertical axis, creating impacts separated vertically by a distance of 18 mm.

Total flow rates per unit length (that is to say for all the holes in the two rows) of cooling water, at the start of casting, of 0.45 to 0.60 liters per linear cm of mould perimeter/min were tested. The flow rate was then increased to 1 liter/cm/min in permanent regime.

The temperature of the cooling water was 15°±2° C. in the three cases.

In all the cases the film boiling length at the the mould exit was measured by the method known by the term ISTM (Ingot Surface Temperature Measurement), which consists in measuring the surface temperature of the ingot by placing a contacting thermocouple on said surface under the impact of the lower cooling jet, recording the temperature during a 5 mm descent of the ingot, and then repeating the operation throughout the transient casting start-up phase.

The temperature curve as a function of the length of cast ingot exhibits a level stage as from the origin, the relatively abrupt end of which corresponds to the end of the film boiling for a length corresponding to the "film boiling length" entered on the Y-axis in FIG. 1 as a function of the start-up flow per unit length.

It should be noted that the film boiling is obtained, for a mould with a single row of jets with an angle of incidence of 30° (reference 30), only for a start-up flow per unit length of less than or equal to 0.45 liters/cm/min. In the case of moulds with a double row of jets (marked 45-22 and according to the invention marked 32/22), this can be obtained for start-up flows per unit length of up to 0.6 liters/cm/min.

Thus, for a given water temperature, the moulds with a double row of jets (activated simultaneously) make it possible to obtain stable calefaction for higher start-up flows than a mould with a single row of jets. There is no significant influence of the angles of incidence on the cast length affected by the film boiling regime during start-up.

The surface temperature of the ingots was also measured, substantially at mid width of the rolling face at the mould exit, by the method known by the term ISTM already mentioned.

Its value is entered on the Y-axis, still as a function of the start-up flow rate per unit length and for the same moulds as above, in FIG. 2, where three zones can be seen: zone I without film boiling, zone II with stable film boiling and good soundness of the cast ingot foot, and zone III with film boiling but hot cracking of the ingot foot.

It should be noted that this temperature is much more stable as a function of the water flow rate in the case of the mould with a double row of jets with angles of incidence of 32° and 22° activated simultaneously, according to the invention (reference 32/22), than in that of the mould with a double row of jets with angles of incidence of 45° and 22° activated simultaneously (reference 45/22), which gives rise to hot cracking of the base at a low flow rate (0.55 liters/cm/min), which reduces the operating range to a very restricted domain and, in the case of the mould with a single row of jets at 30°, which does not make it possible to obtain stable film boiling for water flow rates strictly greater than 0.45 liters/cm/min at this water temperature.

This high sensitivity to the surface temperature of the product at the start-up flow rate per unit length is attributed by the applicant respectively to the destabilisation of the boiling film by the 45° jets and to the lack of gradualness of the cooling in the case of the mould with a single row of jets at 30°.

Thus the configuration of the moulds of the prior art, with a double row of jets with angles of incidence of 45° and 22° (reference 45/22) is unsuited to the casting of hard alloys, even in the absence of sequencing of the jets.

In comparison the mould according the invention (reference 32/22) can be used for flow rates per unit length of between 0.4 and 0.6 liters/cm/min, which is particularly advantageous since this wide range of flow rates in particular makes it possible to compensate for any variation in the water temperature.

In summary, the mould according to the invention makes it possible to obtain stable film boiling in the optimum product surface temperature range and within a wide range of start-up flow rates, which was not enabled by the other types of mould of the prior art.

Finally, the butt curl obtained on the ingot was measured and recorded by means of a video camera. The value thereof, that is to say the length by which the edge of the ingot rises, is entered on the Y-axis in FIG. 3, still as a function of the start-up flow rate per unit mould length and for the same moulds as before.

It is noted thereon that the butt curl obtained with the mould according to the invention (reference 32/22) is significantly smaller than that obtained with the other moulds for start-up flow rates of less than 0.6 liters/cm/min, which shows the advantage of the gradual quenching obtained with this spray technology with two simultaneous jets with optimised angles of incidence.

Example 2

Rolling ingots to the 1810 mm×510 mm format made from alloy of the AA3104 type were cast at a speed of 55 mm/min with moulds of two types:

A mould according to the invention, with two rows of horizontal holes placed one above the other, activated simultaneously (angles of incidence 32° and) 22°, all the holes having a diameter of 3.2 mm and being spaced apart on each row by 12 mm, and generating impacts on the product that are distant vertically by approximately 18 mm, each of the holes in the lower row being disposed on the bisection of the gap between two holes in the upper row.

The mould was provided with a graphite insert on all its working surfaces.

A Wagstaff LHC™ mould, the jet impacts of which were also distant vertically by 18 mm.

The temperature of the cooling water was 15°±2° C.

In the part of the ingot corresponding to the permanent casting regime, the size of the solidification cells was measured by means of the image analysis algorithm p*, at various distances from the casting skin.

This algorithm p* is perfectly described in the publications by Ph. Jarry, M. Boehm and S. Antoine, "*Quantification of spatial distribution of as-cast microstructural features*." Light Metals 2001, New Orleans, TMS. Proceedings edited by J L Anjier, and by Ph. Jarry and A. Johansen, "*Characterisation by the p* method of eutectic aggregates spatial distribution in 5xxx and 3xxx aluminium alloys cast in wedge moulds and comparison with sdas measurements*", Solidification of Aluminium Alloys Symposium, Light Metals 2004, Charlotte, TMS. Proceedings edited by Men G. Chu, Douglas A. Granger and Quingyou Han.

The results are set out in FIG. 4, presenting the size of the solidification cells, in μm, as a function of the distance to the casting skin, in mm, the asterisked symbols relating to the mould according to the invention, the symbols in a circle to the Wagstaff LHC mould.

It is noted therein that the mould according to the invention makes it possible to obtain a casting structure (at the ingot periphery, having cell sizes comparable (to within 2 μm) to those obtained with the LHC™ mould, and a similar surface zone thickness, less than 10 mm. The metallurgical response obtained is therefore substantially identical to that afforded by the LHC™ mould.

Example 3

Rolling ingots to the 1670 mm×610 mm and 1810 mm×510 mm formats made from alloy of the AA5182 type were cast with the same mould configuration as for example 2.

The ingots were then hot rolled without sawing of the casting bases.

The typical strip forms obtained are shown in half-width in FIG. 5, to the left in the case of an ingot cast with mould according to the invention (cooling by spraying with two simultaneous jets at optimised angles of incidence of 32°/22° and graphite insert on all the working faces), to the right with a Wagstaff LHC™ mould used during start-up with sequential cooling at 22° and then 45°.

It is observed thereon that edge cracks are produced in the latter case because of the variations in cross section of the product related to the two step butt curl generated, in the first case by the first spray at an angle of incidence of 22° and in the second case by the superimposition of the second spray at an angle of incidence of 45°. The ingot produced by the mould according to the invention exhibits a simple distributed butt curl that thereby causes no cracking during the hot rolling.

The invention claimed is:

1. Device for cooling a vertical semicontinuous casting mould with direct cooling of rolling ingots or extrusion billets, comprising two rows of holes, disposed over the whole of the internal perimeter of the mould cavity, in a lower part thereof where the ingot or billet exits, each of the rows of holes being situated close to a plane perpendicular to the vertical axis of said mould, wherein:

a) the two rows of holes are connected to a single cooling-liquid chamber provided in the body of said mould, wherein said single cooling-liquid chamber does not include a valve, b) the first row of said holes, which is highest in the vertical mould, or furthest upstream with regard to dispensing of the liquid onto the ingot surface, is connected to said chamber by channels for dispensing jets of said cooling liquid onto said ingot or billet with an angle of incidence of 32±5 degrees with respect to the vertical axis of the mould, c) the second row of said holes, which is lowest in the vertical mould, or furthest downstream with regard to the dispensing of the liquid, is connected to said chamber by channels for dispensing jets of said cooling liquid over said ingot or billet with an angle of incidence of 22±5 degrees with respect to the vertical axis of the mould, d) the holes in the second row, the lowest or furthest downstream with regard to the dispensing of the liquid, are disposed substantially on a bisection of a gap between two holes in the first row, which is highest and/or the furthest upstream, relative to the vertical axis of the mould, wherein the diameters of the holes are substantially equal, on the same row and between two rows, in order to be able to simultaneously dispense said liquid with flow rates and speeds substantially equal over the two rows of holes, both during a start-up phase and during a permanent casting regime.

2. Cooling device according to one of claim 1, wherein the two rows of holes are disposed with respect to each other so as to produce jets which, if they are straight, form, at any moment during casting, both during start-up and during permanent regime, impacts on a substantially vertical surface containing a working face of the mould, spaced apart from one another by a distance of from 10 to 40 mm in a vertical direction.

3. Cooling device according to claim 1, wherein the diameter of each of said holes in each row is 3 mm±1 mm.

4. Cooling device according to claim 1, wherein spacing between two adjacent holes on the same row is from 10 to 30 mm.

5. Method for using the cooling device according to claim 1 for vertical semicontinuous casting with direct cooling of rolling ingots and/or extrusion billets, said method comprising permitting total flow rate of cooling water for all the holes in the two rows, which is flow leaving the cooling liquid chamber, to be from 0.3 to 0.8 liters/minute per linear cm of mould perimeter, at the beginning of a transient casting start-up phase, which is a phase during which flow of cooling liquid and the casting speed have not reached a steady state value, and then raising flow to a required flow rate for a permanent casting regime.

6. Method according to claim 5, wherein said flow rate of water at the beginning of the transient casting start-up phase is from 0.4 to 0.6 liters/cm/min.

7. Method according to claim 5, wherein the cooling liquid is brought simultaneously to all the holes in the two rows during the casting start-up phase.

8. Method for using a cooling device according to claim 5, for vertical semicontinuous casting of rolling ingots, comprising using a slab casting mould provided with a flat bottom block with edges which lie in a substantially horizontal plane.

9. Method for using a cooling device according to claim 5, for vertical semicontinuous casting of rolling ingots, comprising using a slab casting mould provided with a curved bottom block, so that a middle portion of rolling faces of a product is, during the casting start-up phase, subjected to direct cooling by cooling liquid while regions of a rolling face furthest from the middle portion thereof have not yet left the mould.

10. Method according to claim 5, for the vertical semicontinuous casting of rolling ingots, comprising using a casting mould provided with a flat bottom block with a curved edge, so that a middle portion of faces of products is, during the casting start-up phase, subjected to direct cooling by cooling liquid before regions of the rolling face furthest from the middle portion have left the mould.

11. Method for using a cooling device for vertical semicontinuous casting with direct cooling of rolling ingots and/or extrusion billets according to claim 5, comprising using a casting mould provided, on a working surface thereof, with a graphite insert.

12. Cooling device according to claim 1, wherein spacing between two adjacent holes on the same row is from 10 to 40 mm.

* * * * *